US006306019B1

(12) United States Patent
Finkelman

(10) Patent No.: US 6,306,019 B1
(45) **Date of Patent: *Oct. 23, 2001**

(54) METHOD AND APPARATUS FOR CONDITIONING A POLISHING PAD

(75) Inventor: Alex Finkelman, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/475,518

(22) Filed: Dec. 30, 1999

(51) Int. Cl.[7] ..... B24B 1/00
(52) U.S. Cl. ..... 451/56; 451/443; 451/444
(58) Field of Search ..... 451/56, 443, 444, 451/442, 296, 303, 177, 178, 119, 120

(56) References Cited

U.S. PATENT DOCUMENTS

| | | |
|---|---|---|
| 3,753,269 | 8/1973 | Budman . |
| 4,318,250 | 3/1982 | Klievoneit et al. . |
| 4,672,985 | 6/1987 | Mohr . |
| 4,720,939 | 1/1988 | Simpson et al. . |
| 4,934,102 | 6/1990 | Leach et al. . |
| 5,081,051 | 1/1992 | Mattingly et al. . |
| 5,335,453 | 8/1994 | Baidy et al. . |
| 5,484,323 | 1/1996 | Smith . |
| 5,531,635 | 7/1996 | Mogi et al. . |
| 5,536,202 | 7/1996 | Appel et al. . |
| 5,547,417 | 8/1996 | Breivogel et al. . |
| 5,575,707 | 11/1996 | Talieh et al. . |
| 5,593,344 | 1/1997 | Weldon et al. . |
| 5,611,943 | 3/1997 | Cadien et al. . |
| 5,622,526 | 4/1997 | Phillips . |
| 5,643,044 | 7/1997 | Lund . |
| 5,655,951 | 8/1997 | Meikle et al. . |
| 5,692,947 | 12/1997 | Talieh et al. . |
| 5,725,417 | 3/1998 | Robinson . |
| 5,779,526 | 7/1998 | Gill . |
| 6,086,460 | 7/2000 | Labunsky et al. . |

FOREIGN PATENT DOCUMENTS

| | | |
|---|---|---|
| A1 98/45090 | 10/1998 | (WO) . |

OTHER PUBLICATIONS

Copy of International Search Report for PCT/US00/35457 dated Apr. 27, 2001.

*Primary Examiner*—Timothy V. Eley
*Assistant Examiner*—Dung Van Nguyen
(74) *Attorney, Agent, or Firm*—Brinks Hofer Gilson & Lione

(57) ABSTRACT

A method and apparatus for conditioning a polishing pad is described. The method includes steps of moving a cylindrical roller having an abrasive substance affixed to it against a moving polishing pad. The roller may be actively rotated or reciprocated at variable rates, while maintaining a pressure against the polishing pad. The apparatus includes a cylindrical roller attached to one or more pressure application devices mechanically connected to the roller.

11 Claims, 9 Drawing Sheets

214
258
256
252
250
248
246
244
P
238
237
240
239
242
254
200
224
234
236
218
216
206
208
210
232
222
220
202
212
204

METHOD AND APPARATUS FOR CONDITIONING A POLISHING PAD

FIELD OF THE INVENTION

The present invention relates to a method and apparatus for conditioning a polishing pad. More particularly, the present invention relates to a method and apparatus for conditioning a polishing pad used in the chemical mechanical planarization of semiconductor wafers.

BACKGROUND

Semiconductor wafers are typically fabricated with multiple copies of a desired integrated circuit design that will later be separated and made into individual chips. A common technique for forming the circuitry on a semiconductor is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive toward smaller, more highly integrated circuit designs. Semiconductor wafers are also commonly constructed in layers, where a portion of a circuit is created on a first level and conductive vias are made to connect up to the next level of the circuit. After each layer of the circuit is etched on the wafer, an oxide layer is put down allowing the vias to pass through but covering the rest of the previous circuit level. Each layer of the circuit can create or add unevenness to the wafer that is preferably smoothed out before generating the next circuit layer.

Chemical mechanical planarization (CMP) techniques are used to planarize the raw wafer and each layer of material added thereafter. Available CMP systems, commonly called wafer polishers, often use a rotating wafer holder that brings the wafer into contact with a polishing pad moving in the plane of the wafer surface to be planarized. A polishing fluid, such as a chemical polishing agent or slurry containing microabrasives, is applied to the polishing pad to polish the wafer. The wafer holder then presses the wafer against the rotating polishing pad and is rotated to polish and planarize the wafer.

With use, the polishing pads used on the wafer polishers become clogged with used slurry and debris from the polishing process. The accumulation of debris reduces the surface roughness and adversely affects polishing rate and uniformity. Polishing pads are typically conditioned to roughen the pad surface, provide microchannels for slurry transport, and remove debris or byproducts generated during the CMP process.

One present method for conditioning a polishing pad uses a rotary disk embedded with diamond particles to roughen the surface of the polishing pad. Typically, the disk is brought against the polishing pad and rotated about an axis perpendicular to the polishing pad while the polishing pad is rotated. The diamond coated disks produce predetermined microgrooves on the surface of the polishing pad. Because the linear velocities of the leading, center and lagging portions of the disk are different, the rate of microgrooving is different. This non-uniform microgrooving has led some pad conditioner manufacturers to add a continuous oscillation motion to the rotational movement of the rotary disk pad conditioners. This extra movement can result in part of the wafer being exposed to freshly conditioned portions of the polishing pad and another part of the wafer being exposed to a used portion of the pad.

Another apparatus and method used for conditioning a pad implements a rotatable bar on the end of an arm. The bar may have diamond grit embedded in it or high pressure nozzles disposed along its length. In operation, the arm swings the bar out over the rotating polishing pad and the bar is rotated about an axis perpendicular to the polishing pad in order to score the polishing pad, or spray pressurized water on the polishing pad, in a concentric pattern. These types of pad conditioners often do not provide uniform pad conditioning because they are only applied to a small portion of the width of the pad's surface at any given time. Thus, the pressure of the conditioner against the pad can vary.

SUMMARY

According to a first aspect of the invention, an elongated pad conditioning member comprising an abrasive substance is positioned around a shaft. The shaft has an axis substantially parallel to a plane of a polishing pad. The axis of the elongated pad conditioning member is positioned at greater than 180° to the direction or vector of travel of the polishing pad. A motor is connectable to the elongated pad conditioning member. The motor is configured to variably rotationally reciprocate the exterior circumference of the elongated pad conditioning member at varying speeds about the shaft.

In a further aspect of the invention, a roller has an axis of rotation oriented substantially parallel to a polishing plane of the polishing pad. Additionally, the axis of rotation of the elongated pad conditioning member is positioned at greater than 180° to a direction of travel of the polishing pad. A motor is attachable to the roller providing continuous powered rolling. The motor is configured to continuously roll the outer circumference of the roller at variable speeds about the axis of rotation of the roller.

According to another aspect of the present invention, a method of conditioning a polishing pad includes the steps of providing a polishing pad conditioner having a cylindrical roller with a longitudinal rotational axis, positioning the polishing pad conditioner adjacent the polishing pad so that the longitudinal rotational axis of the roller is oriented substantially parallel to the polishing pad, positioning the polishing pad conditioner so that the longitudinal rotational axis of the roller is not oriented at right angles to a vector or direction of travel of the polishing pad, and moving the roller against the polishing pad while the polishing pad is moving. A pressure is maintained against the polishing pad with the cylindrical roller. The roller is rotationally reciprocated about the longitudinal axis at variable speeds by a motor. In an alternative embodiment, the roller is continuously rotated about the longitudinal axis at variable speeds by a motor.

DETAILED DESCRIPTION OF THE PRESENTLY PREFERRED EMBODIMENTS

Figure 1:
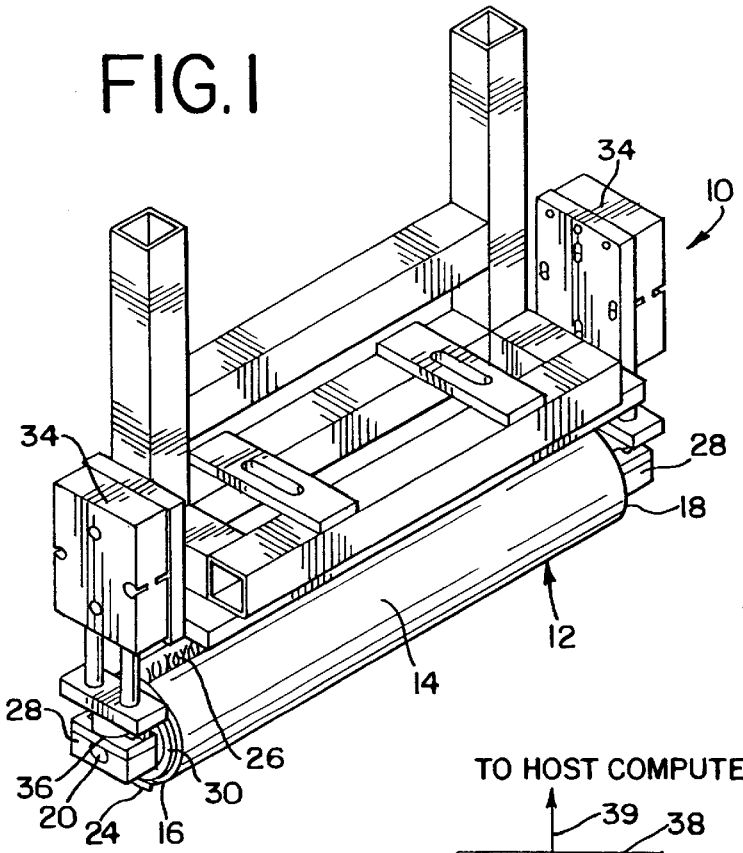
FIG. 1 is a perspective view of a preferred embodiment of a pad conditioning apparatus.
Figure 2:
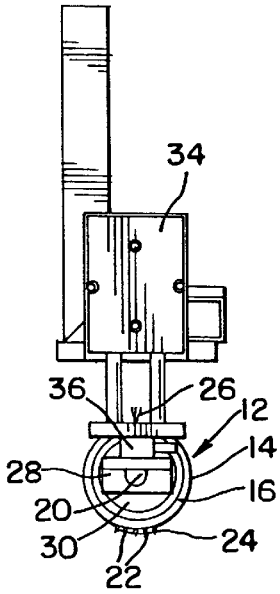
FIG. 2 is a side elevational view of the pad conditioning apparatus of FIG. 1.

FIGS. 1 and 2 illustrate a presently preferred embodiment of a pad conditioner 10 according to the present invention. The pad conditioner 10 includes a roller 12 having a cylindrical outer circumference 14 and first and second ends 16, 18. An abrasive substance, such as a diamond grit 22, is embedded in a strip 24 affixed along a longitudinal portion of the outer circumference 14 of the roller 12. The diamond grit 22 may have a density of 50 to 200 grit. Preferably, the diamond grit is dispersed randomly along the strip 24. The strip 24 may have any desired width. In another embodiment, a brush 26 is longitudinally disposed on the outer circumference 14 of the roller 12 on an opposite side of the roller from the abrasive material. The brush 26 may be made of a commonly available material such as nylon. For simplicity, FIGS. 1 and 2 illustrate the embodiment of the pad conditioner 10 having both a strip 24 of diamond grit 22 and a longitudinally disposed brush 26, however in a preferred embodiment the pad conditioner preferably only has the abrasive substance on the roller.

The roller 12 preferably includes a coaxially disposed shaft 20 extending through the length of the roller. Alternatively, the shaft may be two separate coaxial segments extending partway in from each of the ends 16, 18 of the roller 12. In yet another embodiment, the shaft 20 may extend only partly into one of the ends 16, 18 of the roller. As shown in FIGS. 1 and 2, connectors 28 on either end 16, 18 of the roller hold the shaft 20. A sealed motor 30 connects the outer circumference 14 of the roller to the shaft 20. Preferably, the shaft is maintained in a fixed position and the motor rotates the outer circumference 14 of the roller 12 about the shaft 20. In other embodiments, the motor may be positioned outside of the roller 12 and connected to the shaft 24 by a commonly available linkage mechanism such as a chain and sprocket assembly. The motor of the embodiment of FIGS. 1 and 2 is designed to rotationally reciprocate the outer circumference 14 of the roller 12 about the axis of the roller. The frequency and magnitude of the oscillations may be adjusted. Although any of a number of commonly available motors may be used to rotationally oscillate the roller, the motor is preferably a sealed motor such that slurry and debris do not damage the motor. A sealed motor also prevents oils and other contaminants from escaping the motor and adversely affecting the polishing ability of the polishing pad.

Figure 3:
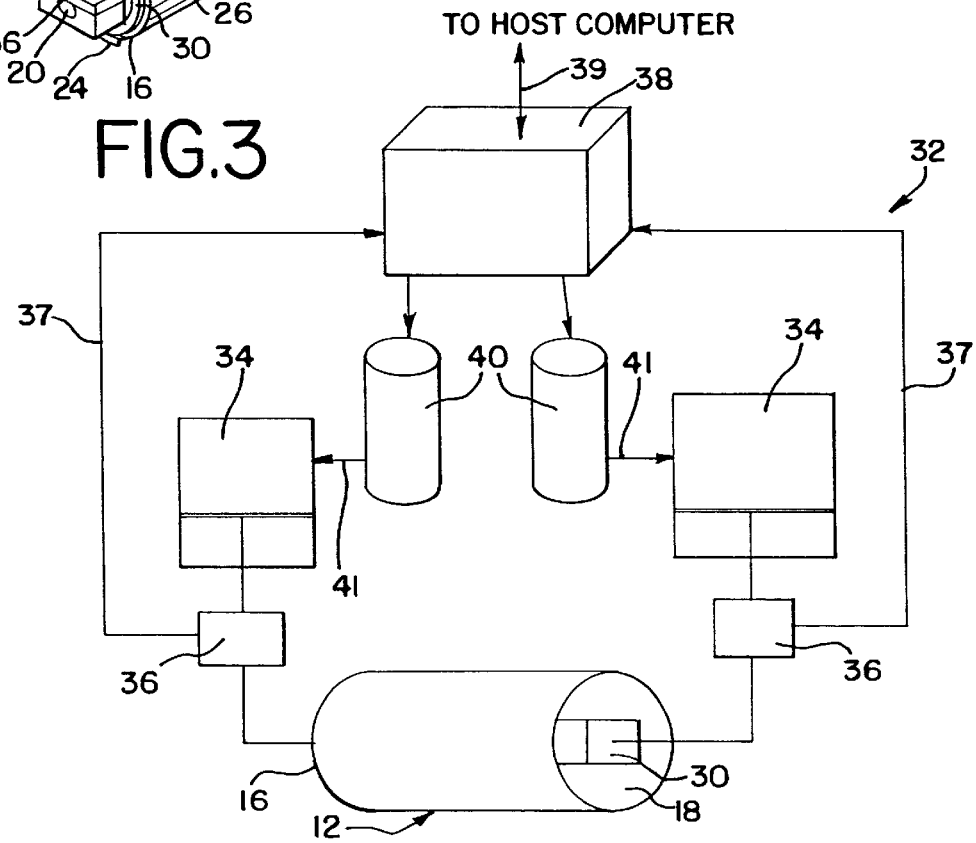
FIG. 3 is a schematic diagram of a preferred pressure control diagram of a pressure control system for use with the pad conditioner of FIG. 1.

The pad conditioner 10 also includes a pressure control system 32. As shown in FIG. 3, the pressure control system 32 includes pressure control devices 34, such as air cylinder and piston assemblies, attached to each end 16, 18 of the roller 12 via load cells 36. Each load cell 36 is electrically connected to a central controller 38 over a feedback line 37 (FIG. 3). The central controller 38 determines the adjustments necessary to each end of the roller in order to maintain a desired pressure of the roller against the polishing pad being conditioned. The controller 38 maintains the desired pressure on each end of the roller by controlling two proportional control valves 40, each connected to a respective one of the pressure application devices 34 via a control line 41. Each pressure application device 34 is therefore independently controllable by the central controller 38 to provide a uniform pressure across the polishing pad. The feedback loop created by the signals coming from the load cells 36 to the controller enables the pad conditioner 10 to maintain highly accurate pressure control at each end of the roller. A command line 39 connects the central controller 38 to a host computer (not shown) that can adjust the operational parameters of the pad conditioner 10, such as pressure threshold and speed of rotational oscillation.

In one embodiment, the central controller 38 may be an embedded processor, such as a Zilog Z 180 or a Motorola HC11, running standard PID software. The pressure application devices may be hydraulic or pneumatic cylinder and piston assemblies. A lead screw or other actuator may also be used as the pressure application device 34. The load cells may be pressure transducers such as Sensotec Model 31/1429-04 available from Sensotec in Columbus, Ohio.

Figure 4:
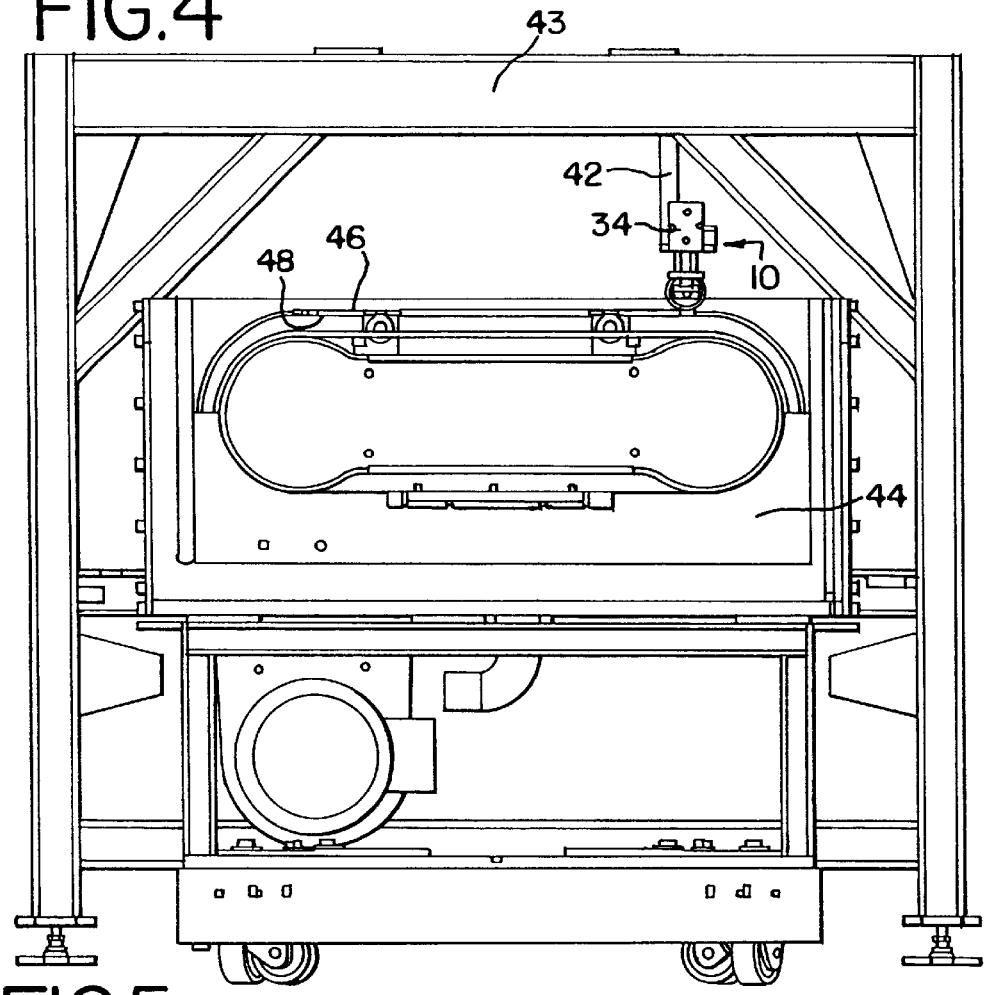
FIG. 4 is a side view of the pad conditioner of FIG. 1 used with a linear belt polishing device.
Figure 5:
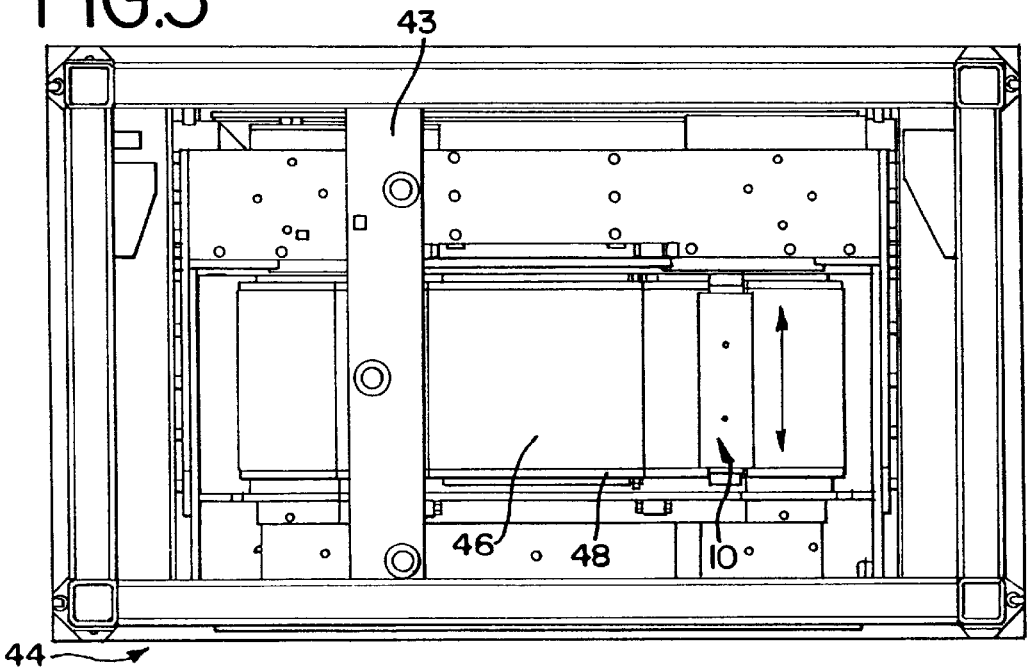
FIG. 5 is a top view of the polishing pad conditioner and linear belt polishing device of FIG. 4.

FIG. 4 illustrates one environment in which a preferred embodiment of the rotary pad conditioner may operate. In FIG. 4, the rotary pad conditioner 10 is positioned on a support member 42 attached to a frame 43 of a wafer polisher 44. The wafer polisher 44 may be a linear belt polisher having a polishing pad 46 mounted on a linear belt 48 that travels in one direction. The pressure application device 34, shown as a cylinder and piston assembly in this embodiment, acts both to provide the downforce for the roller against the polishing pad and to extend and retract the roller from the pad. In one embodiment, the pressure application device may provide a downward pressure in the range of 0–10 p.s.i. The wafer polisher 44 may be a linear belt polisher such as the TERES™ polisher available from Lam Research Corporation of Fremont, Calif. The alignment of the pad conditioner 10 with respect to the polishing pad 46 is best shown in FIGS. 4 and 5. Preferably, the axis of rotation (i.e. the longitudinal axis of the shaft) for the roller 12 on the pad conditioner 10 is parallel to the polishing pad 46 and the roller is aligned such that its axis of rotation is also perpendicular to the direction of motion of the polishing pad 46. Although the pad conditioner may have a roller length that is less than the width of the polishing pad, the length of the roller is preferably substantially equal to or greater than the width of the polishing pad to allow for an even pressure profile across the entire polishing pad.

Figure 6:
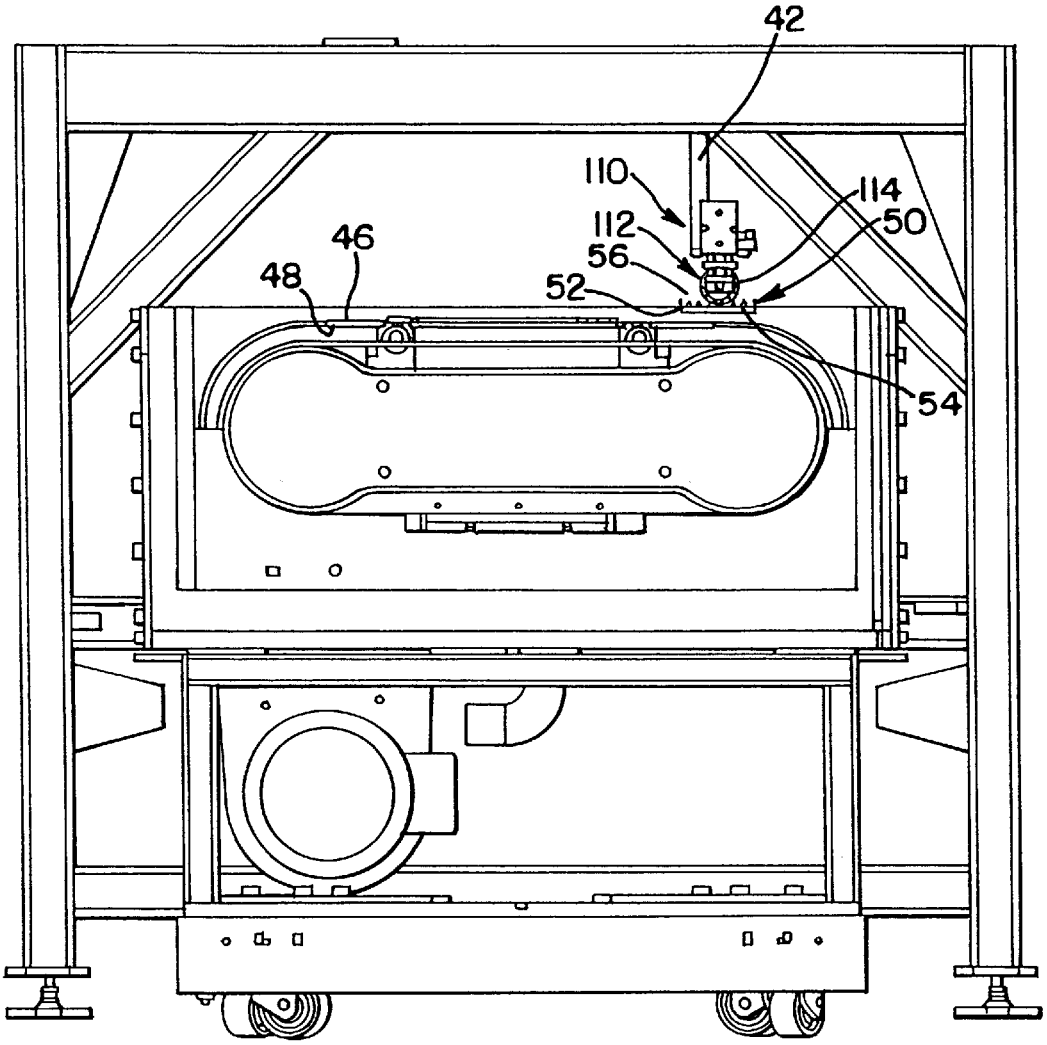
FIG. 6 is an alternative embodiment of the polishing pad conditioner and linear belt polisher of FIG. 4 including a roller bath.
Figure 7:
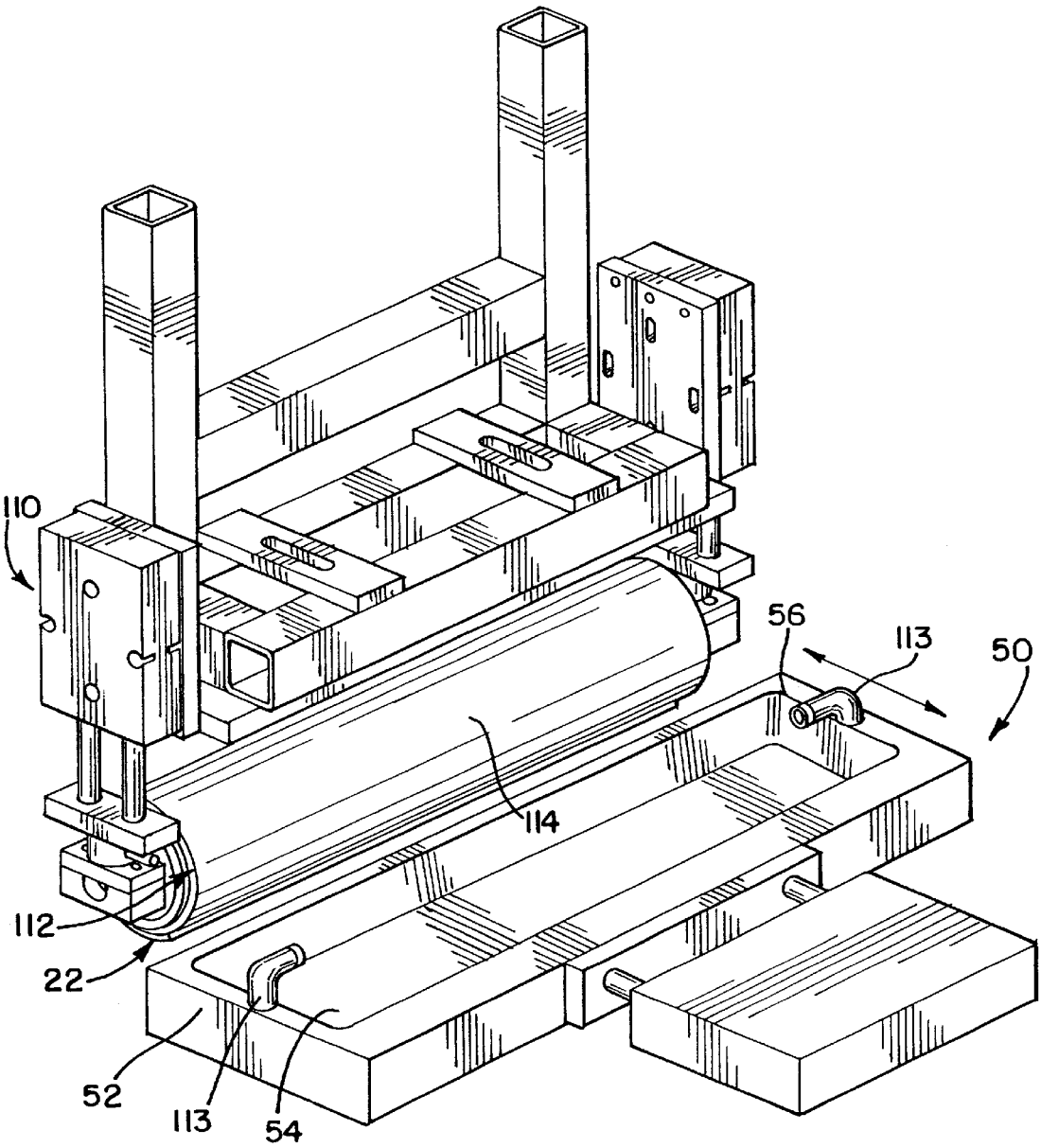
FIG. 7 is a perspective view of the polishing pad conditioner and roller bath of FIG. 6.

FIGS. 6 and 7 show an alternative embodiment of the pad conditioner 110. In the embodiment of FIGS. 6 and 7, the pad conditioner 110 includes a roller bath 50 sized to receive a portion of the outer circumference 114 of the roller 112.

The roller bath 50 is preferably movable so that it can be positioned under the roller 112 as desired. The purpose of the roller bath is to periodically rinse the diamond grit 22 and/or the brush 26 on the roller 112. The roller bath includes a tub 52 having a liquid reservoir 54 and an opening 56 sized to receive a portion of the outer circumference 114 of the roller 112. The roller bath 50 may also include one or more spray nozzles 113 to spray the roller 112 with deionized water or other suitable rinsing fluid. The roller bath 50 may be movably connected to the rest of the pad conditioner 110 or the polisher by an actuator 116 such as a pneumatic piston and cylinder assembly. Preferably, the roller bath is controllable to move under or away from the roller 112. One suitable liquid for the liquid reservoir 54 is deionized water. As will be apparent to those of skill in the art, other liquids may be used.

Figure 8:
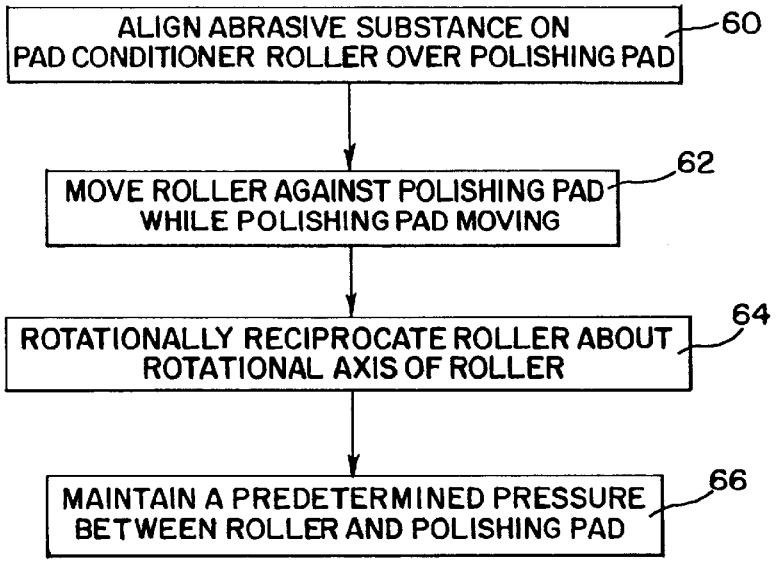
FIG. 8 is a flow diagram illustrating a preferred method of conditioning a polishing pad.

Referring to FIG. 8, a preferred method of conditioning a polishing pad utilizing the pad conditioners 10, 110 described above is set forth below. The pad conditioner controller 38 receives a signal to begin conditioning the pad 46 and instructs the roller 12 to align the strip 24 of grit 22 toward the pad (at step 60). The controller 38 controls the proportional control valves 40 to activate the pressure application devices 34 connected to the ends 16, 18 of the roller and lower the roller against the polishing pad (at step 62). The polishing pad 46 is preferably already moving when the roller contacts the pad. In one embodiment, the pad 46 is moving linearly on a belt 48 or strip. In other embodiments, the pad may be moving in a circular direction on a rotating disk support.

While the roller is lowered, the motor 30 begins to rotationally reciprocate the roller about the shaft 20 (at step 64). The roller is preferably reciprocated so as to rotate the grit 22 back and forth against the pad. The rotational amount of the reciprocation may be adjusted. A preferred rotational amount is the circumferential width of the strip 24 so that the grit 22 is in continuous contact with the pad. The frequency of reciprocation is adjustable through controlling the motor. One suitable strip width for the strip of grit is 1 inch and a suitable reciprocation frequency is 10 r.p.m. for a 14 inch roller having a 2 inch diameter. In other embodiments, the width of the grit, or other abrasive, may be narrower or wider and the reciprocation adjusted to suit the roller size, abrasive type and amount, and desired conditions. In another embodiment, the entire outer circumference 14 of the roller may be coated in an abrasive and continuously rotate in one direction.

An advantage of the presently preferred pad conditioner is that a varying grit profile is presented to the pad because of the rotational reciprocation and the random distribution of grit on the strip of abrasive attached to the roller. Thus, uniform grooves in the pad are avoided and a more even overall roughness may be created on the pad. In another preferred embodiment, the pad conditioning process may also include the step of moving the polishing pad from side to side as illustrated by the arrow designated "belt steering" in FIG. 5.

In addition to reciprocating the roller, the pad conditioner 10 maintains a constant pressure between the roller and pad (at step 66). The load cells 36 at each end of the roller each generate a signal proportional to the pressure applied by the air cylinder and piston of the pressure application device 34. The load cells send their separate signals to the controller 38 which can individually adjust the pressure applied at the two ends of the roller. The continuous feedback of sensed pressure, coupled with individual control for each end of the roller permit a substantially even pressure against the pad. Irregularities and variations are sensed and compensated for by the controller through the feedback system.

After the pad and roller have been in contact for a desired amount of time, the pressure application devices 34 retract the roller. If the pad conditioner includes a brush 26, the central controller 38 instructs the motor 30 to rotate the roller until the brush is aligned over the polishing pad 46. The roller is again lowered against the pad and rotationally reciprocated. The reciprocating action of the brush against the pad helps to remove loose slurry and debris generated by the first part of the pad conditioning process.

Following a conditioning or brushing of the pad, the pad conditioner may clean itself off in the roller bath. The roller bath moves underneath the roller and the air cylinders of the pressure application devices lower at least a portion of the roller into the liquid reservoir. The motor reciprocates the roller to loosen and dislodge slurry or debris. The one or more spray 113 nozzles in the tub may also activate to further clean the grit. If both the abrasive grit and the brush require cleaning, then the roller rotates until the brush is aligned over the liquid reservoir in the tub and the cleaning process is repeated for the brush.

Another embodiment of the polishing pad conditioner 200 is shown in FIGS. 9–12. In this embodiment, the pad conditioner 200 has a passively rotatable roller 202 consisting of a precision ground stainless steel cylinder, plated with an abrasive substance such as diamonds, that is rigidly coupled to a shaft 204 via set screws. Diamonds corresponding to 100 grit (163 microns) size are preferably deposited and plated over the roller such that the entire surface of cylinder is uniformly covered with sharp diamond pyramids oriented normal to the surface of the cylinder. The shaft 204 may be made from 440C stainless steel, hardened to a Rockwell hardness of 50 to 55 and machined to close tolerances so that resulting radial run-out is less than 0.0001 inch. Two bearings 208 support the shaft 204. The bearings 208 may be commercially available bearings such as those having a classification of ABEC 4 or higher. Two brackets 210 mount securely to a plate 212 and support the resulting assembly.

Figures 10, 11:
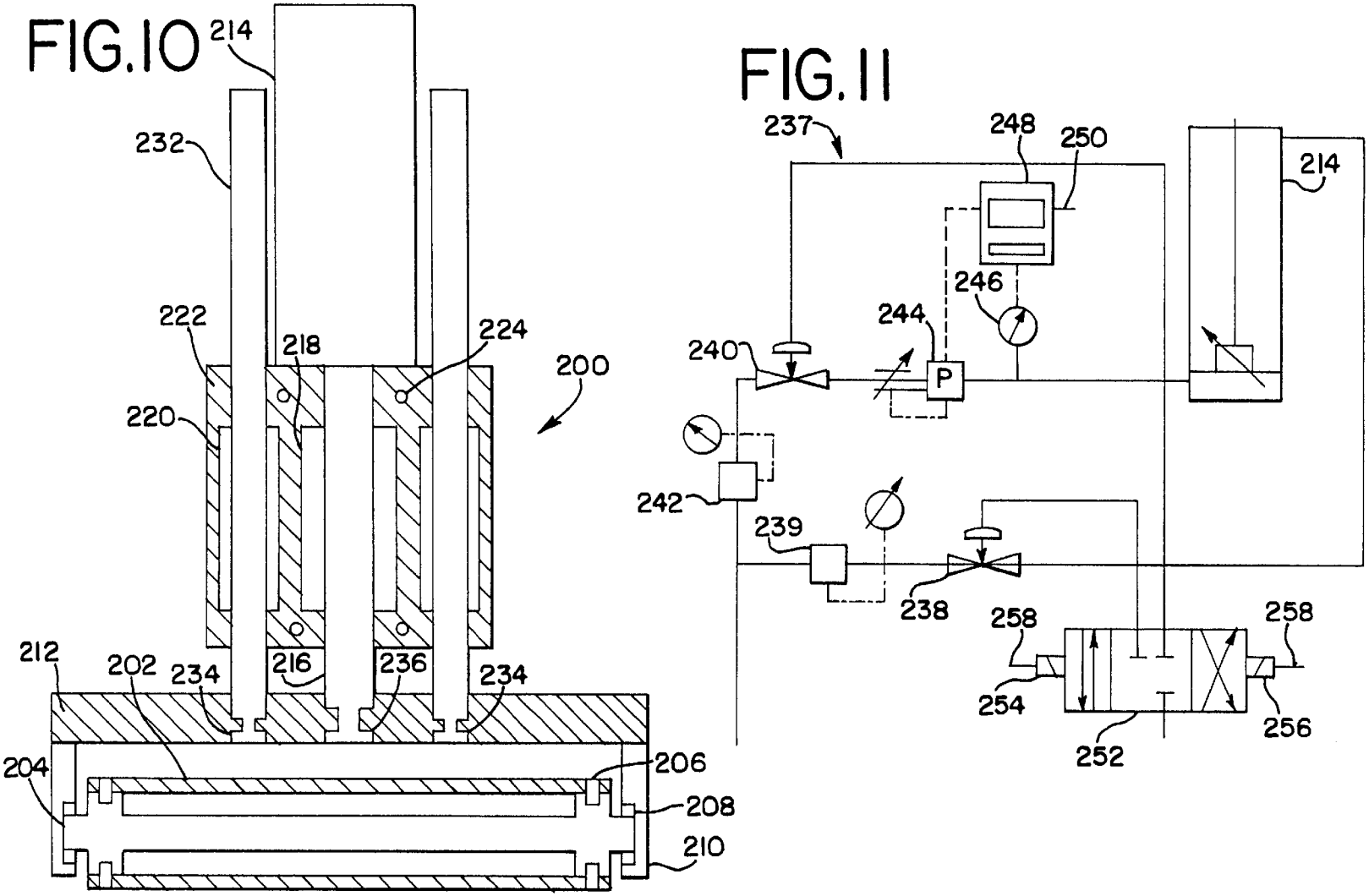
FIG. 10 is a sectional view of the polishing pad conditioner of FIG. 9.
FIG. 11 is a schematic diagram of a downforce control system for the polishing pad conditioner of FIG. 9.

FIG. 10 shows the cross-sectional view of the pad conditioner 200. The brackets 210, plate 212 and attached roller 202 are preferably movable by a commercially available double acting cylinder 214 with cushioned pads on both sides. One suitable double acting cylinder with cushioned pads is the AV 1×2"-B available from PHD, Inc. of Fort Wayne, Ind. The shaft 216 of the cylinder 214 is guided by a linear bearing 218 to achieve smooth system operation and limit friction. A mounting block 222 serves as an attachment block for cylinder 212. The mounting block 222 securely bolts to an alignment plate 226 with four bolts 224. In addition to containing the linear bearing 218 for the cylinder shaft 216, the mounting block 222 contains linear bearings 220 that slidably guide two guide shafts 232 positioned on either side of the cylinder shaft 216. During operation, the cylinder 214 is subject to various loads, such as normal, side and torsion loads. In order to compensate for this loading, the two guide shafts 232 are securely attached to the plate 212 with Allen-head screws 234. Each guide shaft 232 is mounted on linear guide bearings 220 and is free to slide in a direction parallel to the cylinder shaft 216 via. The shaft 216 of the double acting cylinder 214 is also securely attached to the plate 210 with an Allen-head screw 236 in order to increase the system's mechanical stability and resistance to side loads. Suitable guide shafts 232 may be 0.500 inch diameter precision-ground and hardened metal shafts.

To counterbalance the weight of the system, two compensating springs 228 are added to the assembly. Preferably, the springs are mounted coaxially around each of the guide shafts between a slide bushing 230 and the mounting block 222. Required counterbalance force is adjusted by moving the two sliding bushings 230 to compress the spring 228 the desired amount. The mounting plate 226 allows alignment of the roller 202 to the surface of the belt pad and attaches the pad conditioner assembly 200 to the frame of the wafer polisher 44 (FIGS. 4–6).

Precise downforce control on the roller is achieved by using a continuous automated downforce controller 237 as shown in FIG. 11. In the idle state of operation a first valve 238 is turned ON and a second valve 240 is turned OFF. This action provides a necessary retracting force to cylinder 212. Pressure that is available to the supply side of the first valve 238 is regulated by a first pressure regulator 239 in the range of 1 to 10 pounds per square inch (p.s.i.). During operation, the second valve 240 is ON and the first valve 238 is OFF. Pressure that is available to the supply side of the second valve 240 is regulated by a second pressure regulator 242 in the range of 5 to 20 p.s.i. Pressure at the second valve 240 is continuously controlled by an electro-pneumatic regulator 244 and monitored by a pressure sensor 246. Both the electro-pneumatic regulator 244 and pressure sensor 246 are in closed loop control mode via a controller 248. The regulator 244 may be a Pressure Control Valve ITV 2000 available from SMC Corp. of Tokyo, Japan. The pressure sensor 246 may be a ThruTube transducer and the controller may be a Multi-Channel Digital Controller Model LR3400 both available from Span Instruments, Inc. of Plano, Tex.

The controller 248 continuously exchanges downforce information such as set point values, pressure on/off commands, data on the difference between requested downforce and actual downforce, etc. with a process module controller (not shown) via a RS 232 link 250. Both valves 238, 240 are controlled by a pneumatic signal supplied by a 4-way/3 position solenoid controlled valve 252. Solenoids 254 and 256 get ON/OFF commands from the process module controller over digital I/O lines 258. In this manner, the system 200 achieves quick downforce response and feedback with a minimum of components. In one preferred embodiment, the process module controller may be a Pentium® based PC configured to allow direct analog/digital interface with controllers, motors, valves, and the like and is in communication with a wafer polishing system controller. The wafer polishing system controller may be an embedded PC such as the Pentium MMX® PCA-6153 Single Board Computer, commercially available from Advantech Technologies, Inc. of Santa Clara, Calif., used in the TERES™ wafer polisher available from Lam Research Corporation in Fremont, Calif.

Figure 9:
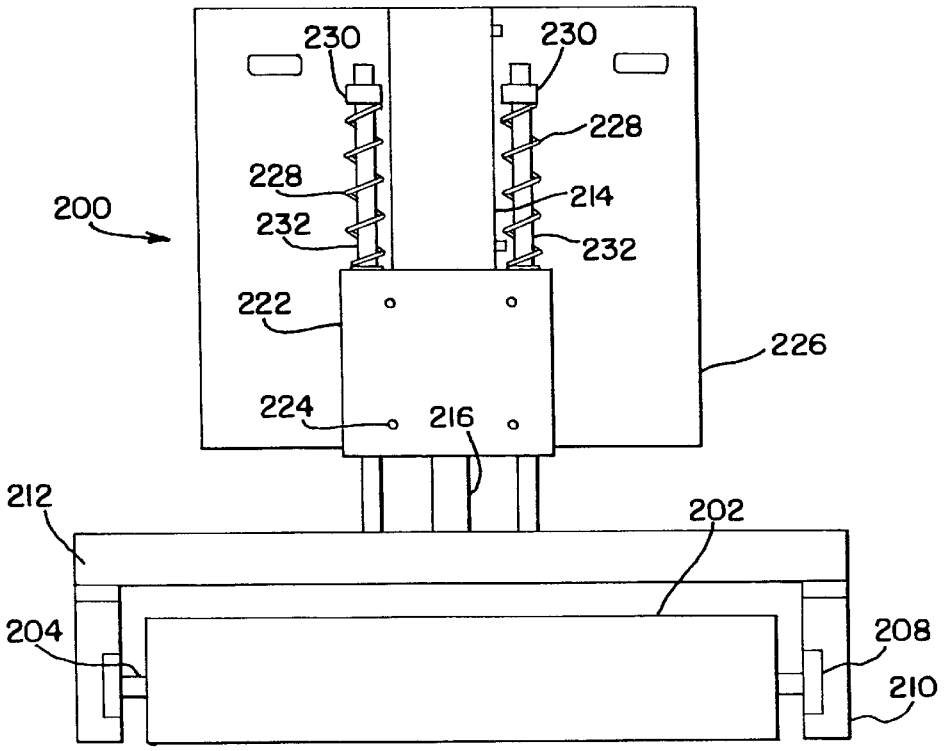
FIG. 9 is an alternative embodiment of a polishing pad conditioner.

In a wafer polishing system using the pad conditioner 200 of FIGS. 9–11, a semiconductor wafer to be polished is brought under pressure on to the polishing pad. In a preferred embodiment, the wafer polishing system is a linear belt polisher, such as the TERES™ polisher available from Lam Research Corporation, with a polishing pad 46 mounted on the belt. The belt is preferably capable of moving with linear velocities ranging from 50 to 1000 linear feet per minute. During polishing, the polishing pad conditioner 200 is lowered against the polishing pad by the cylinder and shaft 214, 216. The downforce controller 237 controls the cylinder 214 so that a constant pressure is continuously applied to hold the roller against the polishing pad. Although the cylinder may operate to apply pressures of 0.1 to 100 p.s.i. to the polishing pad surface, the cylinder preferably operates to produce a constant pressure in the range of 1 to 6 p.s.i. during conditioning, and most preferably is operated to maintain a pressure of 1 p.s.i. at the surface of the polishing pad. The pad conditioner may be adjusted to continuously contact and condition the polishing pad, to contact the polishing pad only after a semiconductor wafer is polished on the wafer polisher, or to intermittently polish the polishing pad during a wafer polishing process.

A plurality of discrete contacts between the diamond points embedded on the surface of the roller 202 form a single line of contact with the surface of the pad 46 and generate a multitude of micro-cuts in the pad as the roller is driven by the linear motion of the polishing pad attached to the belt. In this manner, the pad is conditioned by the action of the diamond grit removing a fine layer of material from the pad and exposing micro-pores on the top surface of the pad. The pores are cut by the passive rotating action of the roller as the downforce controller 237 maintains the pressure of the roller against the pad 46. Although the roller is rotated by the movement of the pad at a rate that is substantially matched to the linear velocity of the pad, there may be some slip between the roller and pad. The slip of the roller with respect to the pad is kept constant by means of precision downforce control. A basic physical analysis of the cylindrical pad conditioner indicates that both $V_{conditioner}$ and $V_{belt}$ are related according to the relation: $V_{conditioner}=K \times V_{belt}$, where K is a slip factor. Experimentally, K has been found to range from 0.95 to 0.98 thus providing very close match between conditioning cylinder and belt pad. It is contemplated that rollers having a slip factor (K) less than 0.95 may also be used.

Figure 12:
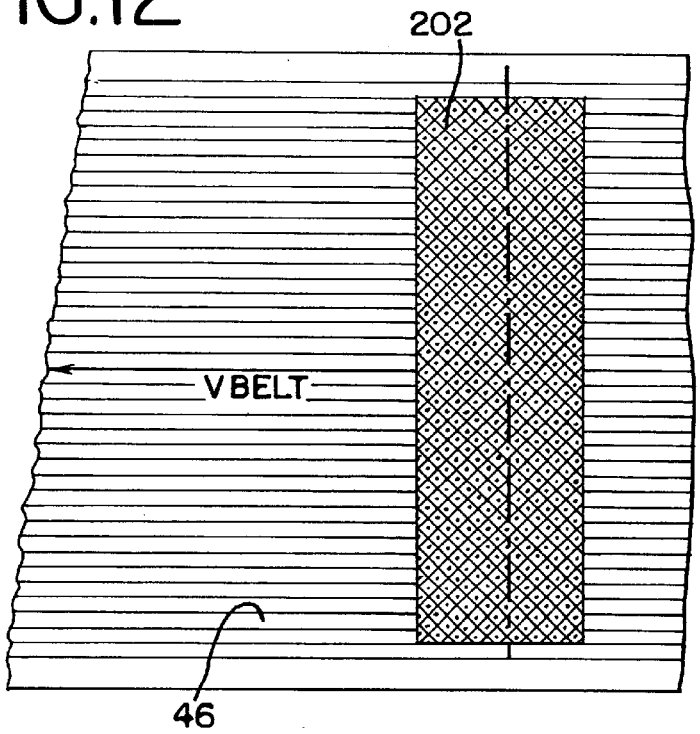
FIG. 12 illustrates a position of the roller of the polishing pad conditioner of FIG. 9 with respect to a polishing pad.
Figure 13:
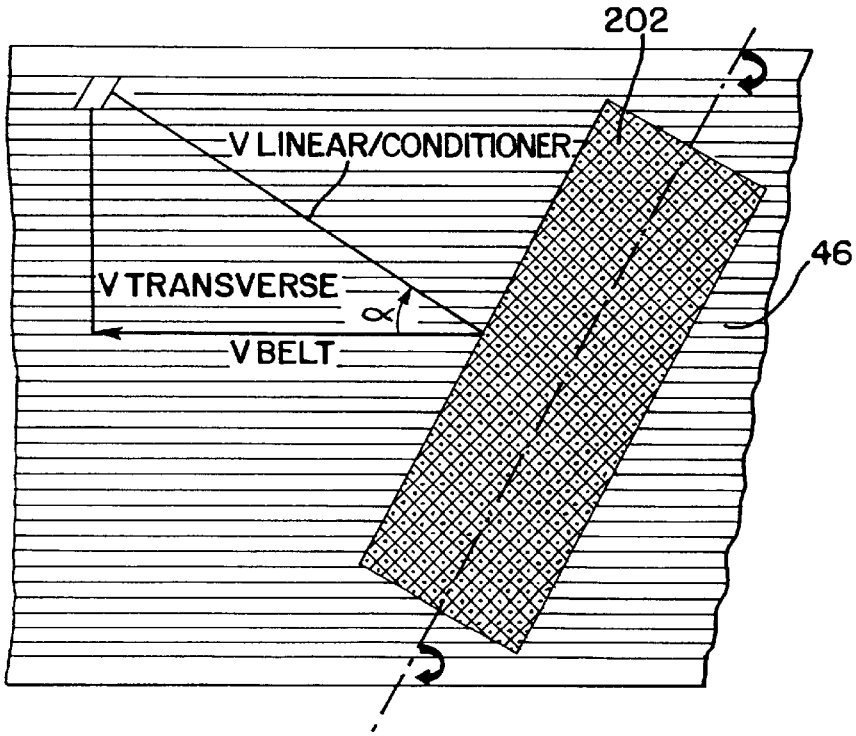
FIG. 13 illustrates an alternative position of the roller of the polishing pad conditioner of FIG. 9 with respect to a polishing pad.

Although the roller's orientation may be as shown in FIG. 12, where the axis of rotation is perpendicular to the velocity vector of the polishing pad, the roller is preferably maintained at a non-perpendicular angle with respect to the velocity vector of the polishing pad. When the roller is oriented as shown in FIG. 13, the cutting action of the diamond grit on the roller produces uniform cross-cuts on the pad and avoids prolonged contact time and linear scratches on the pad surface.

If $V_{belt}$ (the velocity of the belt) determines time of the contact between each single diamond embedded in the roller and the pad material and $V_{transverse}$ determines cutting action of the single diamond against micro-contact area of the pad, then the relationship between the $V_{belt}$ and $V_{transverse}$ may be described as following: $V_{transverse}=\text{tangent}\ (90-\alpha)\times V_{belt}$ where $\alpha$ is the angle defined by the roller's rotational axis and the direction of rotation of the polishing pad. In one embodiment, $V_{transverse}$ may be in the range of 150 to 250 linear feet per minute, with corresponding values of alpha from 60 to 70 degrees.

FIGS. 14, 14*a*, 15 and 15*a* illustrate another aspect of a pad conditioner 300 according to presently preferred embodiment. This embodiment is capable of leaving marks not only along the direction of travel of the pad but also at a variety of angles to the direction of movement of the pad.

Figure 14:
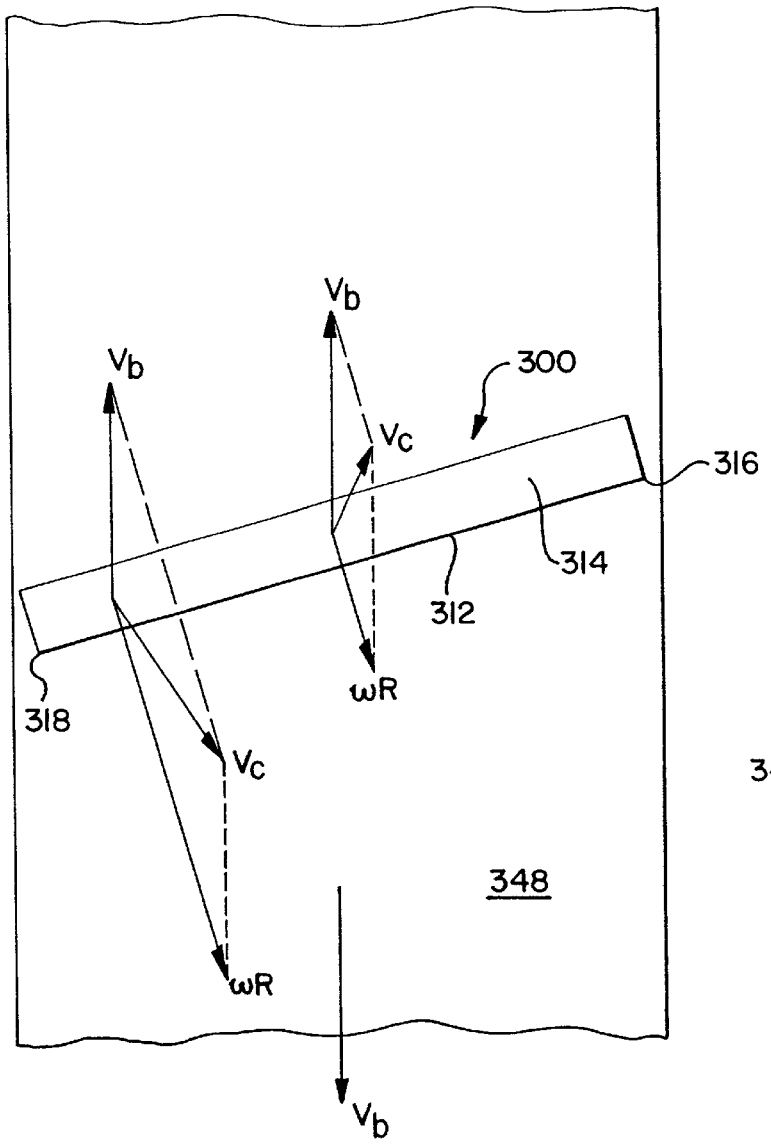
FIG. 14 is a diagram of the vectors of the direction of travel of the conditioner along the belt.
Figure 14A:
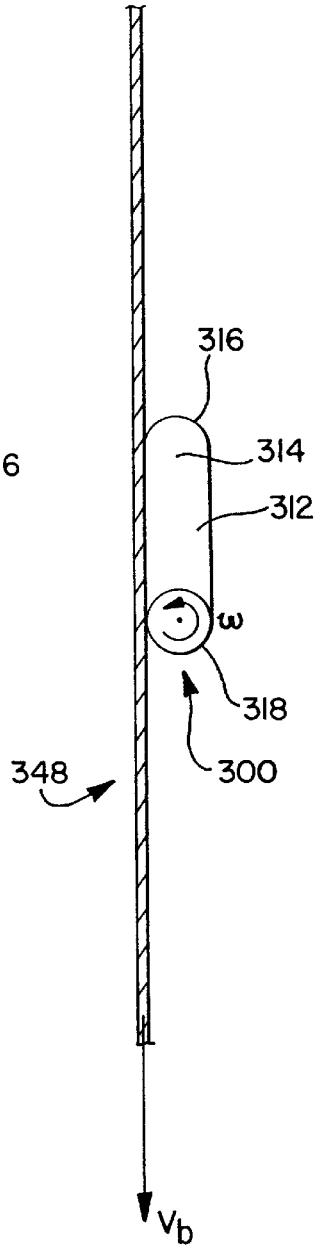
FIG. 14*a* is a side view of a diagram of the vectors of the direction of travel of the conditioner along the belt.
Figure 15:
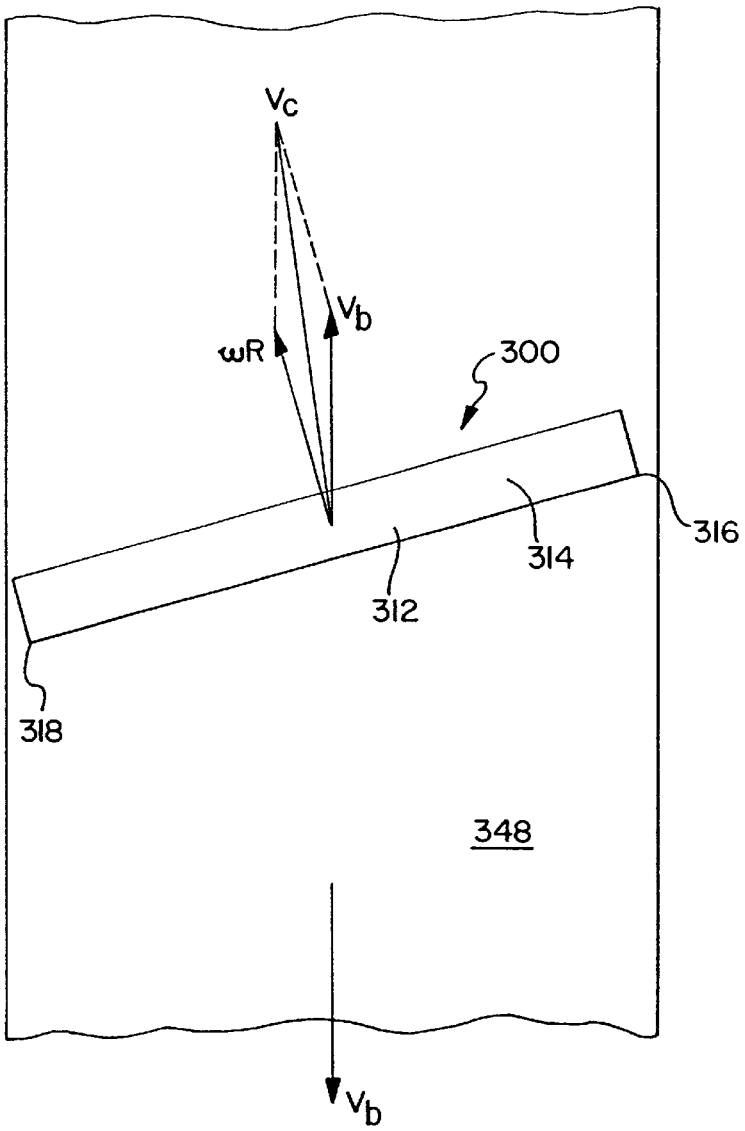
FIG. 15 is a diagram of another aspect of the vectors of the direction of travel of the conditioner along the belt.
Figure 15A:
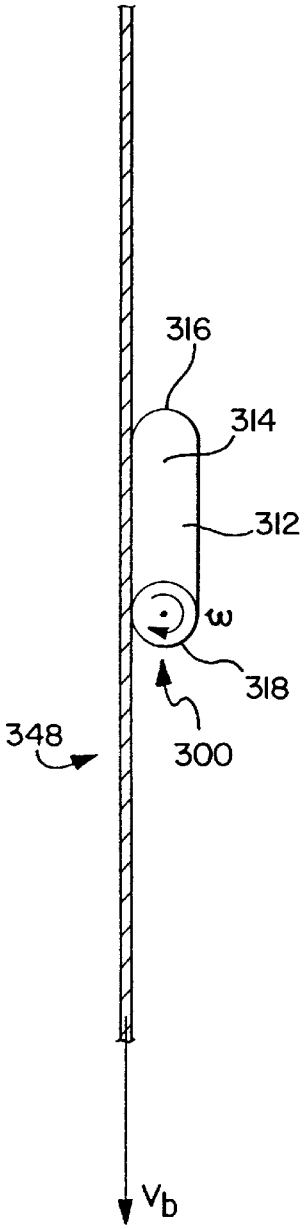
FIG. 15*a* is a side view of a diagram of another aspect of the vectors of the direction of travel of the conditioner along the belt.

In FIGS. 14 and 15, the pad conditioner 300 includes a roller 312 having a cylindrical outer circumference 314 and first and second ends 316, 318. An abrasive substance, such as a diamond grit is embedded in a strip affixed along a longitudinal portion of the outer circumference 314 of the roller 312. In one preferred embodiment, a brush is longitudinally disposed on the outer circumference 314 of the roller 312 on an opposite side of the roller from the abrasive material. The diamond grit may have a density of 50 to 200 grit. Preferably, the diamond grit is dispersed randomly along the strip. The strip may have any desired width. The brush may be of a commonly available material such as nylon. A belt 348, having a polishing pad mounted thereon or integrally formed therewith, travels in conjunction with the roller 312.

The present embodiment of one aspect of the invention includes a roller 312 having a shaft and a sealed motor. The roller 312 of the driven cylindrical pad conditioner 300 is placed not at a right angle with the direction of movement of the pad. That is, the roller 312 of the driven cylindrical pad conditioner 300 is positioned at a non-perpendicular angle with respect to the direction of movement of the pad. With the roller 312 positioned not at a right angle to the pad, marks are left along the pad not only in the direction of movement of the pad but also at a variety of angles to the direction of movement. Marks on the pad will always be the result of speed of the conditioning $V_c$. By changing the value of either the roller's 312 rotational speed or the belt speed, the direction of the vector $V_c$ will also be changed.

The belt 348 travels with a velocity whose vector is indicated as $V_b$ in FIGS. 14 and 15. As shown in FIGS. 14 and 15, $\omega$ represents the rotational velocity of the conditioner whereas R indicates the radius of the conditioner. Multiplying $\omega$ by R gives the linear speed at the circumference of the conditioner, which is caused by the rotation of the shaft. Furthermore, the vector $V_c$ is the result of $V_b+\omega R$.

By positioning the roller not at a right angle to the pad movement but rather at 90-$\beta$ degrees to it, a variety of marks at different angles, varying from zero to approximately 180-$\beta$ degrees, may be left on the pad. Here, $\beta$ the angle of the conditioner placed non-perpendicularly to the direction of pad movement. Also, a change in the rotational speed of the roller 312 influences the various angles of the marks that are left on the pad. These marks of various angles are advantageous at least because they allow for more accurate and variable planarization of semiconductor wafers. Further, the combination of varying the speed of the roller and positioning the roller not at right angles with the direction of travel of the pad allows for improvement of the removal rate and uniformity from the semiconductor wafer surface by the pad.

Another aspect of the present invention includes a method of conditioning a polishing pad. The method includes providing a polishing pad conditioner having a cylindrical roller with a longitudinal rotational axis. The polishing pad conditioner is positioned adjacent the polishing pad so that the longitudinal rotational axis of the roller is oriented substantially parallel to the polishing pad. Further, the polishing pad conditioner is positioned so that the longitudinal rotational axis of the roller is not oriented at right angles to the direction of travel of the polishing pad. The roller is positioned against the polishing pad while the polishing pad is moving. A pressure is maintained against the polishing pad with the cylindrical roller. The roller is rotationally reciprocated about the longitudinal axis at variable speeds by a motor. According to this method, marks on the pad are produced at across or at various angles to the direction of movement of the pad. In yet a further embodiment, the roller 312 continuously rotated about the longitudinal axis at variable speeds by a motor. Marks according to this further embodiment are also produced at various angles to the direction of movement of the pad.

From the foregoing, a method and apparatus for conditioning a polishing pad has been described. One embodiment of the method includes the steps of positioning the pad conditioner over the polishing pad, moving a roller on the pad conditioner against the polishing pad while the pad is moving, rotationally reciprocating the roller of the pad conditioner about the rotational axis of a roller on the pad conditioner, and maintaining a pressure between the roller and polishing pad. If the pad conditioner also has a brush, the pad conditioner can then brush the pad by raising the roller and lowering it again after positioning a portion of the roller attached to a brush over the pad. To clean the pad conditioner after conditioning the pad, a roller bath is moved under the pad conditioner and the roller is rinsed with a liquid by reciprocating desired portions of the roller in the liquid. In a second embodiment, the method includes the steps of aligning a passively rotatable roller at angle with respect to the velocity vector of the polishing pad, pressing the roller into the polishing pad, and maintaining enough pressure to rotate the roller with the force of the moving pad.

A pad conditioner is also disclosed having a roller aligned with its axis of rotation parallel to a pad. In one embodiment, the roller holds a strip of an abrasive substance such as a strip of diamond grit. In another embodiment, the roller holds both an abrasive substance and a brush. A motor connected to the roller is designed to rotationally reciprocate the roller. Pressure application devices connected to each end of the roller and a controller can maintain a desired pressure by the roller against the pad. The pad conditioner then lowers the roller until the brush reaches the pad. The brush acts to sweep the slurry and other debris from the newly roughened pad. The roller may reciprocate to assist the sweeping action, or the roller may simply hold the brush against the pad as it moves underneath it. The pad conditioner again retracts the roller after a desired time period. In another embodiment, a pad conditioner comprises a passive roller rotated by contact with the moving polishing pad. The passive roller is preferably angled with respect to the rotational direction of a linear polishing pad to improve pad conditioning. In yet a further embodiment, a pad conditioner comprises a variably rotational motorized roller. The variably rotational motorized roller may be a rotationally reciprocating roller or a continuously rotating roller where the reciprocation rate or rate of rotation is varied during conditioning of the polishing pad. The motorized roller is positioned at least 180° with respect to the direction of travel of the pad.

It is intended that the foregoing detailed description be regarded as illustrative rather than limiting, and that it be understood that the following claims, including all equivalents, are intended to define the scope of this invention.

I claim:

1. An apparatus for conditioning a polishing pad used in chemical mechanical planarization of semiconductor wafers, the apparatus comprising:

an elongated pad conditioning member rotatably positioned around a shaft, the shaft having an axis substantially parallel to a plane of the polishing pad and wherein the elongated pad conditioning member is positioned at a non-perpendicular angle with respect to a direction of travel of the polishing pad;

an abrasive substance disposed along at least a portion of an exterior circumference of the elongated pad conditioning member;

a pressure application system connected to the shaft and configured to removably press the elongated pad conditioning member against the polishing pad; and a motor connected to the elongated pad conditioning member and configured to rotationally reciprocate the exterior circumference of the elongated pad conditioning member at varying speeds about the shaft while the pressure application system presses the elongated pad conditioning member against the polishing pad.

2. The apparatus of claim 1, wherein the elongated pad conditioning member comprises a cylindrical roller.

3. The apparatus of claim 1, wherein the motor is positioned inside the roller, the shaft is fixed in a non-rotating position, and the motor is configured to rotate the elongated pad conditioning member about the shaft.

4. An apparatus for conditioning a polishing pad used in chemical mechanical planarization of semiconductor wafers, the apparatus comprising:

an elongated pad conditioning member rotatably positioned around a shaft, the shaft having an axis substantially parallel to a plane of the polishing pad and wherein the elongated pad conditioning member is positioned at a non-perpendicular angle with respect to a direction of travel of the polishing pad;

an abrasive substance disposed along at least a portion of an exterior circumference of the elongated pad conditioning member;

a pressure application system connected to the shaft and configured to removably press the elongated pad conditioning member against the polishing pad; and a motor connected to the elongated pad conditioning member and configured to continuously rotate the exterior circumference of the elongated pad conditioning member at varying speeds about the shaft while the pressure application system presses the elongated pad conditioning member against the polishing pad.

5. The apparatus of claim 4, wherein the elongated pad conditioning member comprises a cylindrical roller.

6. The apparatus of claim 4, wherein the motor is positioned inside the roller, the shaft is fixed in a non-rotating position, and the motor is configured to rotate the elongated pad conditioning member about the shaft.

7. A method for conditioning a polishing pad on a linear wafer polisher used in chemical mechanical planarization of semiconductor wafers, the method comprising steps of:

providing a polishing pad conditioner comprising a cylindrical roller having a longitudinal rotational axis and an abrasive substance affixed along at least a portion of an outer circumference of the roller;

positioning the polishing pad conditioner adjacent the polishing pad, wherein the longitudinal rotational axis of the cylindrical roller is oriented substantially parallel to the polishing pad and at a non perpendicular angle with respect to a direction of travel of the polishing pad;

continuously rotating at a variable speed the cylindrical roller against the polishing pad while the polishing pad is moving; and maintaining a pressure against the polishing pad with the cylindrical roller.

8. The apparatus of claim 7, wherein the motor is positioned inside the roller, the shaft is fixed in a non-rotational position, and the motor is configured to rotate the roller about the shaft.

9. A method of conditioning a polishing pad used in chemical mechanical planarization of semiconductor wafers comprising the steps of:

providing a polishing pad conditioner comprising a roller having an abrasive substance longitudinally affixed along a predetermined portion of an outer circumference of the roller, the roller positioned adjacent the polishing pad so as not to be at a right angle with a direction of travel of the polishing pad;

orienting the roller such that the abrasive substance faces the polishing pad;

moving the roller against the polishing pad while the polishing pad is moving;

variably rotationally reciprocating the roller a predetermined rotational distance about a rotational axis of the roller; and, maintaining a predetermined pressure between the roller and the polishing pad while the pad is moving and the roller is reciprocating, whereby the abrasive substance removes excess slurry and debris from the polishing pad.

10. The method of claim 9 further comprising the steps of:

moving the roller away from the polishing pad;

positioning a roller bath under the polishing pad conditioner;

lowering the roller into the roller bath; and rotating the roller about the rotational axis of the roller, whereby slurry and debris are loosened.

11. The method of claim 9, further comprising the steps of:

moving the roller away from the polishing pad;

rotating the roller until a brush affixed to the roller is aligned over the polishing pad; and brushing the polishing pad by lowering the roller against the pad.

* * * * *